US010443164B1

(12) United States Patent
Zheng et al.

(10) Patent No.: US 10,443,164 B1
(45) Date of Patent: Oct. 15, 2019

(54) KNITTING NEEDLE WITH SWIVEL JOINT

(71) Applicants: Liyun Zheng, Troy, MI (US); Aimee Zheng, Troy, MI (US)

(72) Inventors: Liyun Zheng, Troy, MI (US); Aimee Zheng, Troy, MI (US)

( * ) Notice: Subject to any disclaimer, the term of this patent is extended or adjusted under 35 U.S.C. 154(b) by 0 days.

(21) Appl. No.: 15/992,572

(22) Filed: May 30, 2018

(51) Int. Cl.
*D04B 3/02* (2006.01)

(52) U.S. Cl.
CPC ..... *D04B 3/02* (2013.01)

(58) Field of Classification Search
CPC ..... D04B 3/00; D04B 3/02
USPC ..... 66/116, 117, 121, 123
See application file for complete search history.

(56) References Cited

U.S. PATENT DOCUMENTS 2,102,600 A * 12/1937 Miller ..... D04B 3/02 66/117
2,183,791 A * 12/1939 Dunn ..... D04B 3/02 66/117
2,208,124 A * 7/1940 Dunn ..... D04B 3/02 66/117
2,242,880 A * 5/1941 Dunn ..... D04B 3/02 66/117
2,507,174 A * 5/1950 Phillips ..... D04B 3/00 66/118
4,646,543 A * 3/1987 Okada ..... D04B 3/02 66/117
5,720,187 A * 2/1998 Matuo ..... D04B 3/02 66/117
6,397,640 B1 * 6/2002 Williams ..... D04B 3/02 66/117
6,668,597 B2 12/2003 Robinson
8,210,003 B2 * 7/2012 Zheng ..... D04B 3/02 66/117

* cited by examiner

*Primary Examiner* — Danny Worrell
(74) *Attorney, Agent, or Firm* — Reising Ethington P.C.

(57) ABSTRACT

A knitting needle is disclosed, which may include at least one needle member having a tip end and a connector end opposite the tip end, with the needle member having a longitudinal axis extending between the tip end and the connector end. The knitting needle may further include a cable having opposite ends, and a selectively lockable swivel connector joining one of the opposite ends of the cable to the connector end of the needle member. The selectively lockable swivel connector may include a first connector member defining a bore, a second connector member received in the bore, and a radially resilient locking member disposed about the second connector member and received in the bore. The radially resilient locking member may define first and second annular faces at opposite ends of the locking member, respectively.

20 Claims, 3 Drawing Sheets

KNITTING NEEDLE WITH SWIVEL JOINT

BACKGROUND

A circular knitting needle generally includes two needle members joined by a flexible cable. When used in knitting, one or both needle members may be rotated or turned, applying torque to the flexible cable and eventually causing the flexible cable to twist or wind up. Twisting of the cable may make knitting more difficult, requiring one or both needles to be released from the user's hand(s) to allow the cable to be unwound or straightened.

While some knitting needles have been developed with a swivel joint, there is a need for a swivel joint that allows for a secure connection of the needle member to the cable while still allowing the cable to rotate relatively freely with respect to the needle member.

BRIEF DESCRIPTION OF THE DRAWINGS

Referring now to the drawings, exemplary illustrations are shown in detail. Although the drawings represent some examples, the drawings are not necessarily to scale and certain features may be exaggerated, removed, or partially sectioned to better illustrate and explain the present invention. Further, the exemplary illustrations set forth herein are not intended to be exhaustive or otherwise limit or restrict the claims to the precise forms and configurations shown in the drawings and disclosed in the following detailed description:

DETAILED DESCRIPTION

Figure 1:
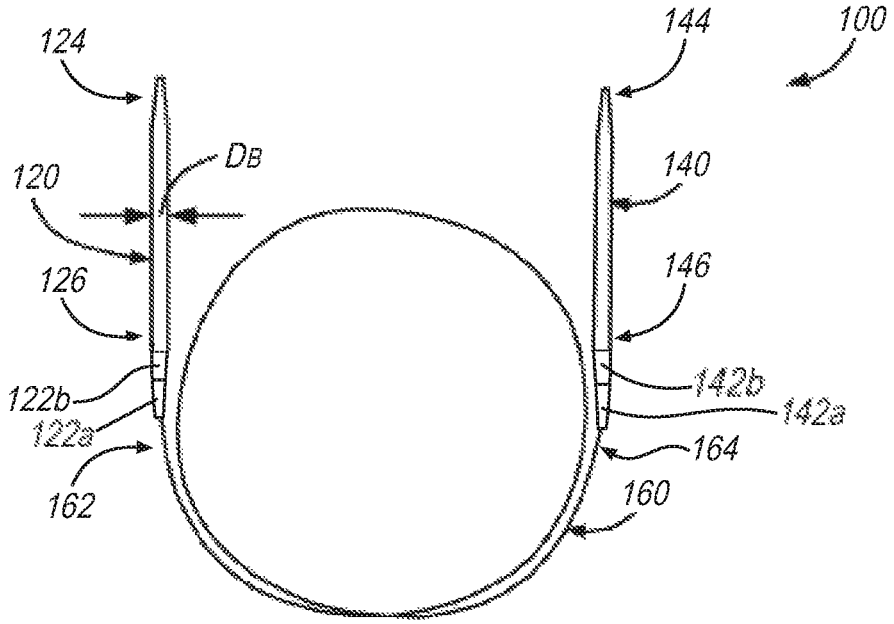
FIG. 1 is a top view of a circular knitting needle including two needle members, with each secured to a flexible cable by way of respective swivel connectors, according to an example approach.

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Example illustrations are provided below of a knitting needle, e.g., a circular knitting needle, which provides connectors for needle members that facilitate relative rotation of the needle members while securely maintaining the needle members axially relative to the cable. Example knitting needles may have one or more needle members having a tip end and a connector end opposite the tip end, with the needle member(s) having a longitudinal axis extending between the tip end and the connector end thereof. The knitting needle may further include a cable having opposite ends, with one of the ends coupled to the connector end of the needle member. The end of the cable may be coupled to the connector end of the needle member with a selectively lockable swivel connector. The selectively lockable swivel connector may include a first connector member defining a bore, a second connector member received in the bore, and a radially resilient locking member disposed about the second connector member and received in the bore. The radially resilient locking member may define first and second annular faces at opposite ends of the locking member, respectively. One of the annular faces of the locking member may engage a corresponding connector annular surface of the first connector member to prevent disengagement of the second connector member from the bore of the first connector member, while also permitting relative rotation between the first and second connector members.

As best seen in FIG. 1, a knitting needle assembly 100 may include first and second needle members 120, 140 connected by a cable 160. While the disclosure is generally directed to knitting needles, in other examples crochet hook assemblies may be employed. Therefore, while discussed in combination with first and second needle members, it is understood that the present disclosure applies equally to arrangements where the first and second needle members 120, 140 are in the form of crochet hooks. As shown in FIG. 1, the knitting needle 100 may be a circular knitting needle, i.e., where the flexible cable 160 may be wrapped in a circular or semi-circular fashion as shown. However, the concepts described herein are not solely limited to circular knitting needles.

The needle members 120, 140, in contrast to the flexible cable 160, may generally be relatively inflexible. In an example, the needle members 120, 140 are each formed of a metallic material, such as stainless steel. As shown in FIG. 1, the size of the needle members 120, 140 may be defined by a laterally extending diameter $D_B$ of the needle main body. The needle members 120, 140 may have any longitudinal length that is convenient. Moreover, while the needle members 120, 140 are illustrated with each having the same diameter and length in FIG. 1, in some examples different diameters and/or length needle members may be employed with the cable 160.

The cable 160 may include a braided metal cable formed from metal strands, which strands are covered with a nylon coating. The braided metal cable and nylon coating (not shown) may be sized to accommodate flexibility and crimping, e.g., to a needle connector as will be discussed below. In one example, a braided metal cable as disclosed in U.S. Pat. No. 8,210,003 is employed.

The needle members 120, 140 may each have a tip end 124, 144, respectively, which may be generally pointed or otherwise configured to facilitate knitting. Connector ends 126, 146 may be disposed opposite the tip ends 124, 144 of each of the needle members 120, 140.

The connector ends 126, 146 may be connected to the cable 160 via respective swivel connectors 122*a*/122*b* (collectively, 122) and 142*a*/142*b* (collectively, 142), respectively. More specifically, the cable 160 may be secured to first connector members 122*a*, 142*a*, at each end thereof. Merely as one example, the first connector members 122*a*, 142*a* may be secured to corresponding ends 162, 164 of the cable 160, respectively, using a crimped connection such as that described in U.S. Pat. No. 8,210,003. Thus, the ends 162, 164 of the cable 160 (including the braided metal cable and the nylon coating thereof) may be located in a bore (not shown in FIG. 1) defined by the respective first connector members 122*a*, 142*a*.

Any size or configuration of the cable 160 may be employed that is convenient. In one example, the cable 160 may include a braided metal cable formed from metal strands, with the strands collectively covered with a nylon coating. The braided metal cable and nylon coating may be sized to accommodate crimping to the first connector members 122*a*, 142*a* and a flexibility of the cable 160, as described in U.S. Pat. No. 8,210,003. In another example, for a needle diameter less than 4.0 millimeters (mm), the cable 160 includes an overall diameter of 1.0 mm to 1.6 mm. The cable 160 may be formed from a relatively large number of metal strands, e.g., 40 to 60 strands, with each of the strands having a diameter between 0.01 mm and 0.015 mm. In other examples, a greater number of strands may be used. Generally, larger numbers of strands may be used where the strands themselves are smaller in diameter, with the increase in number of strands (and smaller diameter of the individual strands) providing increased overall flexibility of the cable 160. The nylon coating may define a wall thickness of 0.2 mm to 0.3 mm, merely as one example.

Figure 2A:
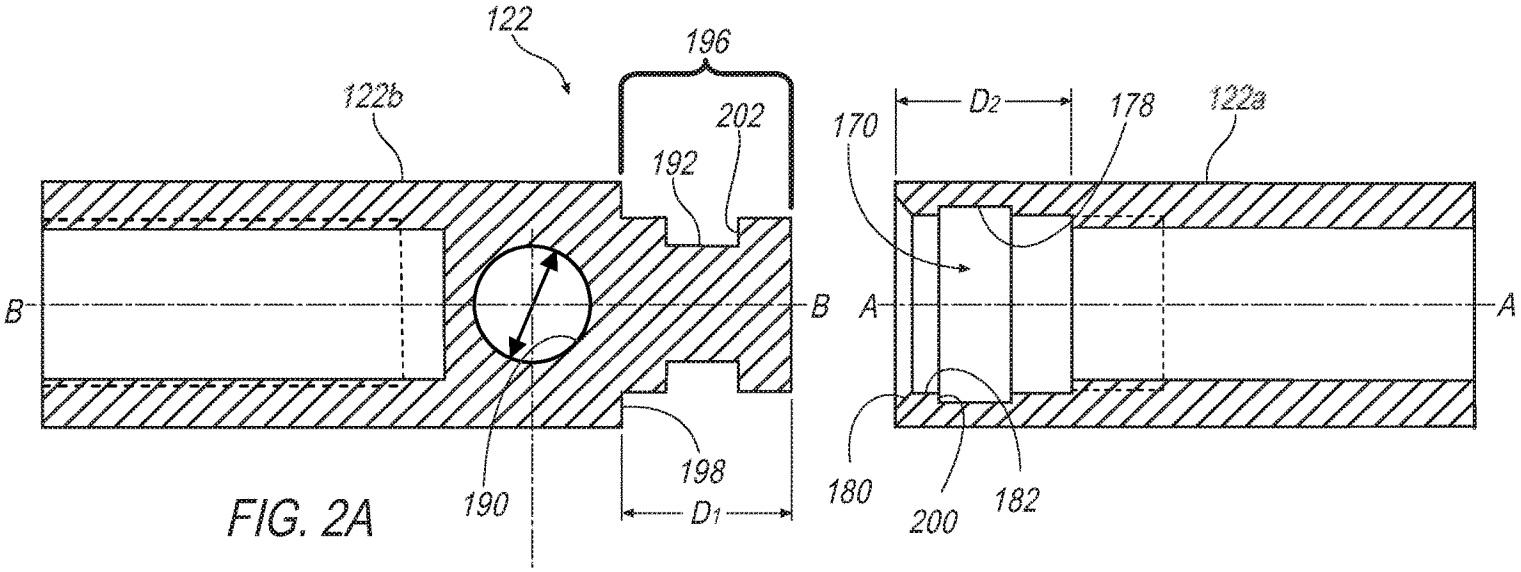
FIG. 2A is an enlarged section view of one of the swivel connectors of FIG. 1 to illustrate first and second connector members and a locking member, according to one example approach.
Figure 2C:
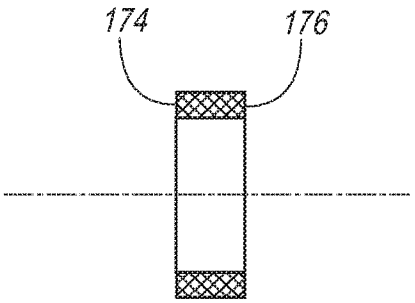
FIG. 2C is a section view of the locking member of FIG. 2B, taken through line 2C-2C.
Figure 2B:
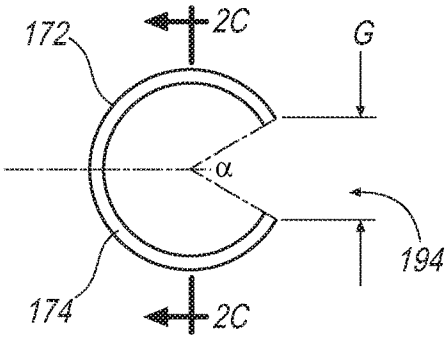
FIG. 2B is a longitudinal or end view of the locking member of FIG. 2A.

Turning now to FIGS. 2A-2C, the connectors 122, 142 will be described in further detail. While the following examples are illustrated in connection with swivel connector 122, it is to be understood that in some examples the connector 142 provided at the opposite end of cable 160 may also be a swivel connector. Accordingly, the following description of swivel connector 122 may be equally applicable to the other connector 142. Moreover, in some examples, the connectors 122, 142 may be identical, e.g., with respect to construction, configuration, and/or the manner in which they facilitate swiveling or rotation of the needle members 120/140 with respect to cable 160. Nevertheless, it is not required that both needle members 120, 140 be connected to the cable 160 with swivel connectors, as in some examples only one swivel connector may be needed.

As seen in FIGS. 2A-2C, swivel connector 122 may be a selectively lockable swivel connector that includes a first connector member 122*a* and a second connector member 122*b*. The section view of the first and second connector members 122*a*, 122*b* in FIG. 2A (as well as those in FIGS. 3A-3C referred to below) shows one section of the connector members 122*a*, 122*b*. In some examples, the connector members 122*a*, 122*b* may have an identical section around the entire circumference, or substantially the entire circumference, of the generally cylindrical members 122*a*, 122*b*. Thus, the various annular surfaces described below which are defined by the first and second connector members 122*a*, 122*b* may similarly extend about the entire circumference, or substantially the entire circumference, of the first and second connector members 122*a*, 122*b*.

The first connector member 122*a* defines a bore 170 configured to receive the second connector member 122*b*, as will be discussed further below. Moreover, the first and second connector members 122*a*, 122*b* are configured to permit relative rotation between the two connector members 122*a*, 122*b* when they are fully engaged with each other. In other words, while the second connector member 122*b* is generally fixed axially with respect to the first connector member 122*a* when the two connector members 122*a*, 122*b* are engaged, they may generally be freely rotated relative to each other when engaged. In this manner, any twisting of the needle member(s) 120 and/or 140, e.g., during knitting, is generally not transferred to the cable 160, thereby reducing or preventing twisting or windup of the cable 160.

The second connector member 122*b* may be formed as a separate part from the needle member 120, or may be integrally formed as part of the needle member 120 at the connector end 126 thereof. Where the second connector member 122*b* is a separate part from the needle member 120, the second connector member 122*b* may be secured to the needle member 120 by a threaded connection, or any other method that is convenient. To this end, a connector aperture 190 may be provided extending through the second connector member 122*b*, which may facilitate gripping the second connector member 122*b* to the extent necessary to secure a threaded connection with the associated needle member 120.

The swivel connector 122 further includes a radially resilient locking member 172 which is illustrated in FIGS. 2B and 2C. As will be described further below, the locking member 172 may be disposed about the second connector member 122*b* and may prevent the disengagement of the first and second connector members 122*a*, 122*b* when assembled. In one example, the radially resilient locking member may be a generally c-shaped ring defining an annular gap, which may generally facilitate assembly of the locking member 172 onto the second connector member 122*b*. The radially resilient locking member 172 may define a first annular face 174 and a second annular face 176, which are disposed at opposite ends of the locking member 172, respectively. In one example, the locking member 172 is formed of a metallic material, e.g., stainless steel. The locking member 172 may resiliently deflect to facilitate assembly of the first and second connector members 122*a*, 122*b* together, as will be described further below.

Turning back to FIG. 2A, the bore 170 of the first connector member 122*a* may define a radially outer cavity 178, which faces radially inwardly within the bore 170 and, as will be described further below, is configured to receive the radially resilient locking member when the second connector member is fully inserted into the bore 170. The bore 170 may also define a radially inwardly extending ramp 180 defining an oblique angle with respect to a longitudinal axis A-A of the bore 170. The ramp 180 may be a chamfer positioned at the end of the first connector member 122*a*, which generally guides insertion of the second connector member 122*b* into the bore 170. Additionally, the oblique angle of the ramp 180 with respect to the axis A-A may generally urge the radially resilient locking member 172 radially inwardly when the second connector member 122*b* is inserted into the bore 170, as will be discussed further below. The oblique angle of the ramp 180 with respect to the axis A-A of the bore 170 may be 45 degrees, as illustrated in FIG. 2A, however any angle that is convenient may be employed. The bore 170 may also define a cylindrical lip 182. The cylindrical lip 182 may extend from the ramp 180 to the radially inwardly facing groove 178.

Figure 3B:
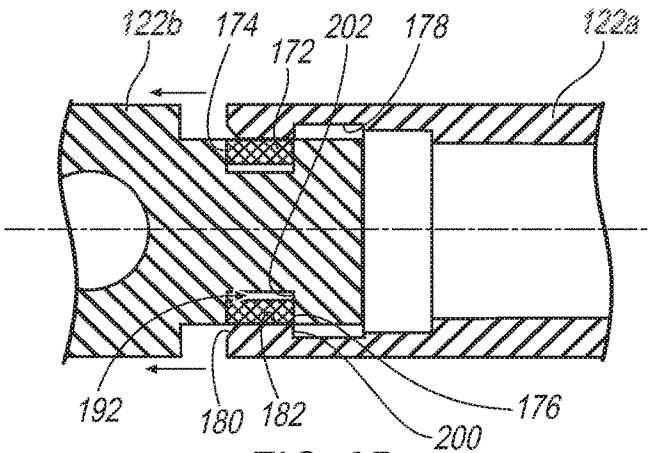
FIG. 3B is a section view of the first and second connector members and locking member of FIG. 3A, showing the second connector member as it is inserted further into the bore of the first connector member.
Figure 3A:
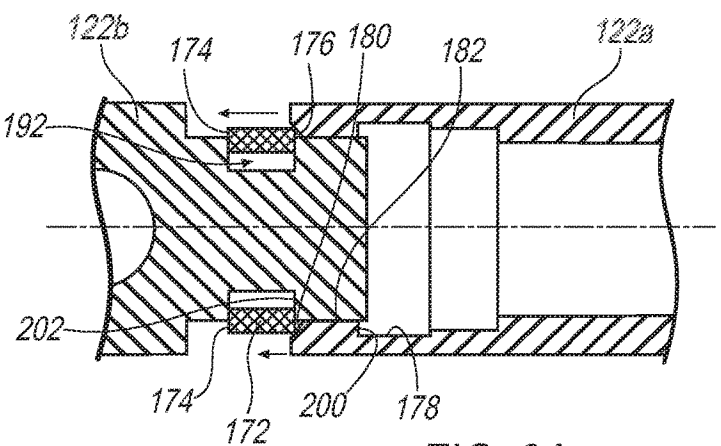
FIG. 3A is a section view of the first and second connector members of FIG. 2A and the locking member of FIGS. 2B and 2C, showing the second connector member just before insertion into a bore of the first connector member.
Figure 3C:
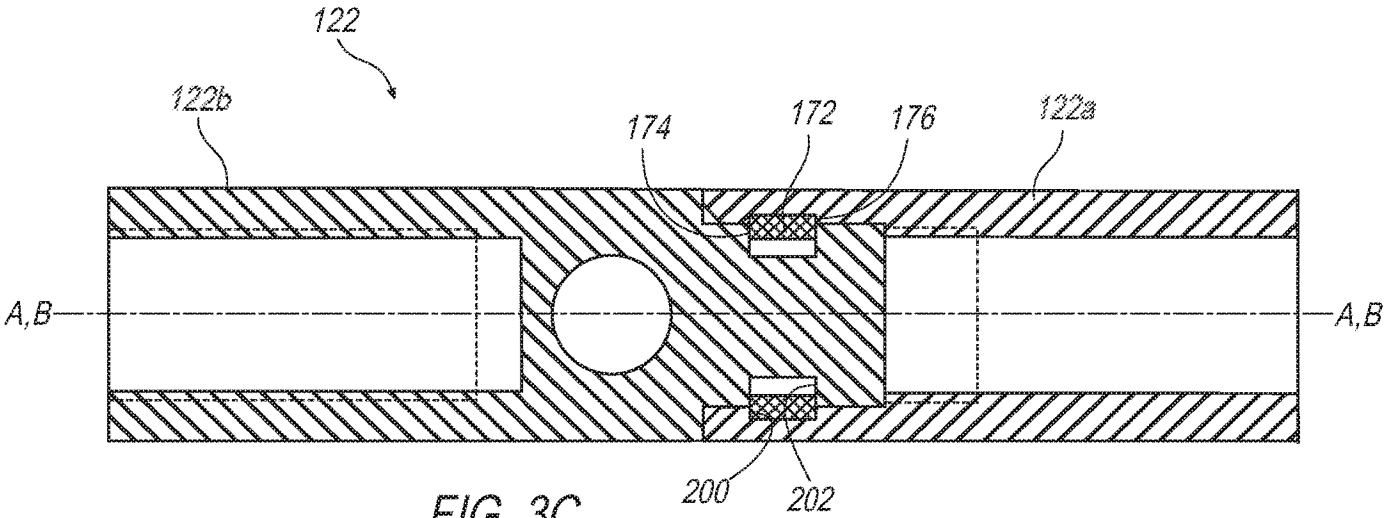
FIG. 3C is a section view of the first and second connector members and locking member of FIGS. 3A and 3B, showing the second connector member after it is fully inserted into the bore of the first connector member.

Turning now to FIGS. 3A-3C, the assembly of the first and second connector members 122*a*, 122*b* will be described in further detail. As best seen in FIG. 3A, the locking member 172 may initially be placed around the second connector member 122*b*. For example, the locking member 172 may be placed on to the second connector member 122*b* by placing the locking member 172 adjacent an inner groove 192 of the second connector member 122*b*, and forcing the second connector member 122*b* through the annular gap 194. The annular gap 194 may extend a gap distance G that is smaller than a diameter of the second connector member 122*b* at the inner groove 192, such that the locking member 172 is resiliently deflected as it is assembled onto the second connector member 122*b*. Additionally, the smaller magnitude of the gap distance G prevents the locking member 172 from falling off of the second connector member 122*b* (at least in the absence of a force spreading the ends of the locking member 172 sufficiently apart).

The annular gap 194 may be defined by an angular extent of the gap 192 with respect to the generally circular locking member 172. For example, as best seen in FIG. 2B, the annular gap 194 may define an angle $\alpha$. In one example, the angle $\alpha$ is approximately 60 degrees.

With the locking member 172 positioned about the second connector member 122*b*, the second connector member 122*b* may be inserted into the bore 170 until the locking member 172 is brought into contact with the ramp 180 of the bore 170, as shown in FIG. 3A. As the second connector member 122*b* is inserted further into the bore 170, the ramp 180 generally squeezes the locking member 172 radially inward (the ends of the locking member 172 defining the annular gap 194 may be brought closer together as a result of this squeezing). Moreover, the ramp 180 may generally facilitate a relatively smooth insertion and connection of the first and second connector members 122*a*, 122*b* by way of the ramp 180 gradually squeezing the locking member 172 as the locking member 172 is moved axially along the ramp 180. The second connector member 122*b* is inserted further, as shown in FIG. 3B, with the locking member 172 eventually fitting within the cylindrical lip 182 of the bore 170. The cylindrical lip 182 may be cylindrical in shape, as shown.

The locking member 172 may generally slide along the cylindrical lip 182 as the second connector member 122*b* is inserted further into the bore 170 of the first connector member 122*a*, until the locking member 172 reaches the radially inwardly facing groove 178. As best seen in FIG. 3C, upon reaching this axial position the locking member 172 may spring radially outwardly, fitting at least partially into the radially inwardly facing groove 178 of the first connector member 122*a*. In one example, as best seen in FIGS. 3A and 3C, the second connector member 122*a* may have a narrowed portion 196 which defines an axial protrusion $D_1$. This axial protrusion $D_1$ may correspond to an axial depth $D_2$ of the bore 170. As the narrowed portion 196 is fully inserted into the bore 170, the end of the first connector member 122*a* is brought into contact with shoulder 198 of the second connector member 122*b*. Accordingly, the second connector member 122*b* is inserted into the bore 170 to a predetermined distance, as defined generally by the axial protrusion $D_1$ of the second connector member 122*b*, as well as the axial depth $D_2$ of the first connector member 122*a*. Upon the insertion of the second connector member 122*b* into the bore 170 to the predetermined distance, the locking member 172 may be seated partially into the radially inwardly facing groove 178.

With the locking member 172 positioned at least partially within the radially inwardly facing groove 178, the annular faces 174, 176 generally prevent relative axial movement of the first and second connector members 122*a*, 122*b*. More specifically, the locking member 172 is seated partially within the radially inwardly facing groove 178 of the first connector member 122*a*, and partially within the inner groove 192 of the second connector member 122*b*. For example, the radially inwardly facing groove 178 of the bore 170 may define a radial depth that is less than a radial thickness of the locking member 172, as best seen in FIG. 3C. The first annular face 174 may be adjacent or in abutting contact with a first connector annular surface 200 defined by the radially inwardly facing groove 178 of the first connector member 122*a*. Similarly, the second annular face 176 of the locking member 172 may be adjacent or in abutting contact with a second connector annular surface 202 of the second connector member 122*b*.

As such, an attempt to disengage the second connector member 122*b* from the bore 170 of the first connector member 122*a* will be generally blocked by the locking member 172, preventing relative axial movement that would otherwise withdraw the second connector member 122*b* from the first connector member 122*a*. More specifically, a force urging the second connector member 122*b* out of the bore 170 would force the second connector annular surface 202 against the second annular face 176 of the locking member 172, forcing the first annular face 174 of the locking member 172 against the first connector annular surface 200 of the first connector member 122*a*.

As shown in FIGS. 3A-3C, the first annular face 174 of the locking member 172 and the first connector annular surface 200 of the first connector member 122*a* may be each be substantially orthogonal to the axis A-A of the bore 170. Accordingly, axial force applied to the second connector member 122*b* that would otherwise withdraw it from the bore 170 is counterbalanced by a substantially equal axial force applied by the first connector annular surface 200 to the first annular face 174 of the locking member 172. Additionally, the axial force applied by the first connector annular surface 200 to the first annular face 174 of the locking member 172 imparts substantially zero radial force to the locking member 172. The substantial lack of a radial component to the forces applied by the first and second connector members 122*a*, 122*b* to the locking member 172 in response to relative axial forces acting upon the first and second connector members 122*a*, 122*b* advantageously maintains the radial position of the locking member 172, i.e., such that it remains partially disposed in both the radially inwardly facing groove 178 of the first connector member 122*a*, as well as the radially outwardly facing inner groove 192 of the second connector member 122*b*.

The second connector member 122*b* may also be restricted from further insertion into the bore 170 upon engagement of the locking member 172 into the radially inwardly facing groove 178 of the first connector member. For example, the end of the first connector member 122*a* may engage the shoulder 198 of the second connector member 122*b*. The locking member 172 itself may also resist axial movement of the second connector member 122*b* into the first connector member 122*a* due to the partial insertion of the locking member 172 into both the radially inwardly facing groove 178 and the inner groove 192 of the second connector member 122*b*.

While the locking member 172 generally maintains the relative axial position of the second connector member 122*b* to the first connector member 122*a*, the second connector member 122*b* may generally freely rotate about its axis B-B relative to the first connector member 122*a*. Accordingly, if needle members 120/130 are turned during knitting, this turning is not transferred to the cable 160, thereby preventing the cable 160 from being wound up or twisted.

Additionally, it should be understood that the outer surfaces of the connector members 122*b*, 122*a* may cooperate to define a relatively smooth outer surface when assembled, thereby facilitating sliding of thread across an interface between the needle members 120/140, the first and second connector members 122*b*, 122*a*, and the cable 160.

While the foregoing description has described the second connector member 122*b* as being inserted into a bore 170 of the first connector member 122*a*, it should be understood that this arrangement may be executed in reverse, i.e., the second connector member 122*b* may instead define a bore receiving the first connector member 122*a*.

Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A circular knitting needle, comprising:

first and second needle members, each of the needle members having a tip end and a connector end opposite the tip end, each of the first and second needle members having a respective longitudinal axis extending between the tip end and the connector end thereof;

a cable having opposite ends, each of the opposite ends coupled to the connector end of a respective one of the first and second needle members;

wherein one of the opposite ends of the cable is coupled to the connector end of the respective needle member with a selectively lockable swivel connector, the selectively lockable swivel connector including a first connector member defining a bore, a second connector member received in the bore, and a radially resilient locking member disposed about the second connector member and received in the bore, the radially resilient locking member defining first and second annular faces at opposite ends of the locking member, respectively;

wherein one of the annular faces of the locking member engages a corresponding connector annular surface of the first connector member to prevent disengagement of the second connector member from the bore of the first connector member while permitting relative rotation between the first and second connector members.

2. The circular knitting needle of claim 1, wherein the bore defines a radially inwardly extending ramp defining an oblique angle with respect to a longitudinal axis of the bore.

3. The circular knitting needle of claim 2, wherein oblique angle of the ramp urges the radially resilient locking member radially inwardly when the second connector member is inserted into the bore.

4. The circular knitting needle of claim 2, wherein the oblique angle is 45 degrees with respect to the axis of the bore.

5. The circular knitting needle of claim 1, wherein the first annular face of the locking member and the connector annular surface of the first connector member are each substantially orthogonal to the axis of the bore, such that a longitudinal force applied by the connector annular surface to the first annular face of the locking member imparts substantially zero radial force to the locking member.

6. The circular knitting needle of claim 1, wherein the first connector member defines a radially inwardly facing groove at least partially receiving the locking member when the second connector member is inserted into the bore to the predetermined distance.

7. The circular knitting needle of claim 6, wherein the bore defines a radially inwardly extending ramp defining an oblique angle with respect to a longitudinal axis of the bore.

8. The circular knitting needle of claim 7, wherein the bore defines a cylindrical lip extending from the ramp to the radially inwardly facing groove.

9. The circular knitting needle of claim 6, wherein the radially inwardly facing groove defines a radial depth that is less than a radial thickness of the locking member.

10. The circular knitting needle of claim 6, wherein the radially inwardly facing groove defines the corresponding connector annular surface.

11. The circular knitting needle of claim 1, wherein the locking member defines an annular gap configured to receive the second connector member.

12. The circular knitting needle of claim 1, wherein the locking member is c-shaped.

13. The circular knitting needle of claim 1, further comprising a second selectively lockable swivel connector, the second swivel connector joining the cable to the connector end of the second needle member.

14. The circular knitting needle of claim 1, wherein the second connector and the needle member are separately formed parts.

15. A knitting needle, comprising:

at least one needle member having a tip end and a connector end opposite the tip end, the needle member having a longitudinal axis extending between the tip end and the connector end;

a cable having opposite ends; and a selectively lockable swivel connector joining one of the opposite ends of the cable to the connector end of the needle member, the selectively lockable swivel connector including a first connector member defining a bore, a second connector member received in the bore, and a radially resilient locking member disposed about the second connector member and received in the bore, the radially resilient locking member defining first and second annular faces at opposite ends of the locking member, respectively;

wherein the bore defines a radially inwardly facing groove receiving the radially resilient locking member when the second connector member is inserted into the bore to a predetermined distance, the first annular face of the locking member engaging a corresponding connector annular surface of the first connector member to prevent disengagement of the second connector member from the bore of the first connector member while permitting relative rotation between the first and second connector members.

16. The knitting needle of claim 15, wherein the bore defines a radially inwardly extending ramp defining an oblique angle with respect to a longitudinal axis of the bore, and wherein the oblique angle of the ramp urges the radially resilient locking member radially inwardly when the second connector member is inserted into the bore.

17. The knitting needle of claim 15, wherein the first annular face of the locking member and the connector annular surface of the first connector member are each substantially orthogonal to the axis of the bore, such that a longitudinal force applied by the connector annular surface to the first annular face of the locking member imparts substantially zero radial force to the locking member.

18. The knitting needle of claim 15, wherein the second connector member defines a radially inwardly facing groove at least partially receiving the locking member when the second connector member is inserted into the bore to the predetermined distance.

19. The knitting needle of claim 18, wherein the bore defines a radially inwardly extending ramp defining an oblique angle with respect to a longitudinal axis of the bore, wherein the bore defines a cylindrical lip extending from the ramp to the radially inwardly facing groove, and wherein the radially inwardly facing groove defines a radial depth that is less than a radial thickness of the locking member.

20. The knitting needle of claim 15, wherein the knitting needle is a circular knitting needle comprising at least two needle members.

* * * * *